US006020816A

United States Patent [19]

Agozzino

[11] Patent Number: 6,020,816

[45] Date of Patent: Feb. 1, 2000

[54] DOOR AND WINDOW LOCK WITH BURGLAR ALARM

[76] Inventor: Andrew Agozzino, 7202 NW. 89th Ave., Tamarac, Fla. 33321

[21] Appl. No.: 09/208,178

[22] Filed: Dec. 9, 1998

Related U.S. Application Data

[63] Continuation-in-part of application No. 09/033,297, Mar. 2, 1998, abandoned.

[51] Int. Cl.[7] ..... E05B 45/06

[52] U.S. Cl. ..... 340/542; 340/545.1

[58] Field of Search ..... 340/542, 545.1

[56] References Cited

U.S. PATENT DOCUMENTS

| | | | |
|---|---|---|---|
| 2,660,632 | 11/1953 | Makshima | 200/61.64 |
| 3,587,080 | 6/1971 | Hawkins | 340/542 |
| 3,755,802 | 8/1973 | Bobrowski et al. | 340/542 |
| 3,810,145 | 5/1974 | Gusaras | 340/542 |
| 3,851,325 | 11/1974 | Maged | 340/542 |
| 3,978,467 | 8/1976 | Albert | 340/527 |
| 4,123,752 | 10/1978 | Novotny | 340/542 |
| 4,390,867 | 6/1983 | Queren | 340/542 |
| 4,587,517 | 5/1986 | Engstrom et al. | 340/542 |
| 4,912,456 | 3/1990 | Mickel | 340/542 |
| 5,757,269 | 5/1998 | Roth et al. | 340/542 |

*Primary Examiner*—Glen Swann
*Attorney, Agent, or Firm*—Oltman, Flynn & Kubler

[57] ABSTRACT

An alarm and bolt apparatus for a building opening closure panel hingedly mounted within a perimeter frame in a building opening includes a bolt assembly having a bolt and a mechanism for extending and retracting the bolt, a bolt receiving housing fitted into the closure panel frame, the housing having a forward wall portion with a bolt receiving opening, a side wall portion and a rearward wall portion, an alarm circuit within the building, and a lever switch with a switch lever for operating the switch and electrical switch terminals connecting the switch within the alarm circuit, the switch lever extending within the bolt receiving housing, where the housing is sized in depth relative to the throw of the bolt so that when the bolt is fully extended from the bolt assembly, the bolt extends into the housing to an extent that the bolt is positioned laterally adjacent to the switch lever, so that when the closure panel is moved toward an open position, such movement drives the bolt laterally against the switch lever and thereupon pivots the switch lever to operate the switch and thereby complete the alarm circuit to cause an alarm to sound.

5 Claims, 2 Drawing Sheets

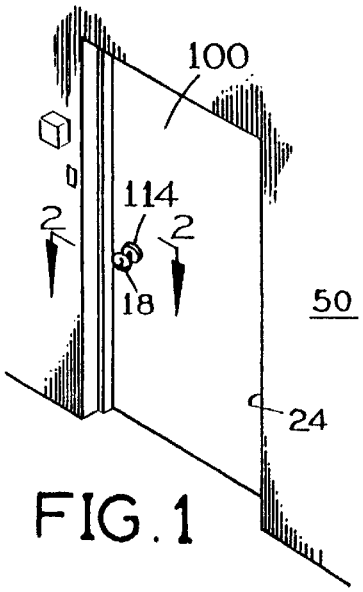
FIG. 1
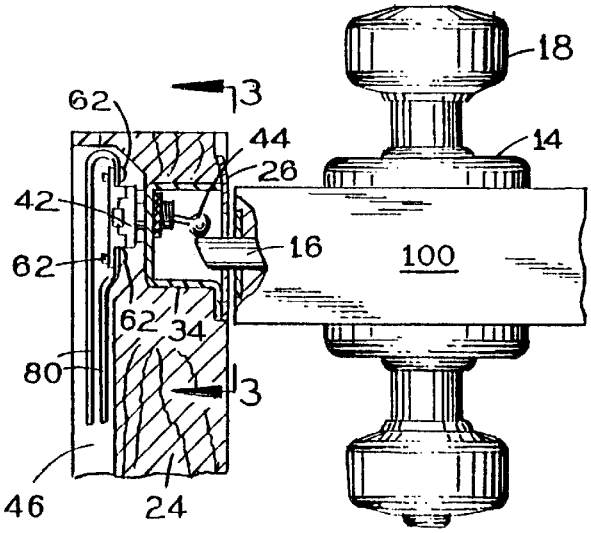
FIG. 2
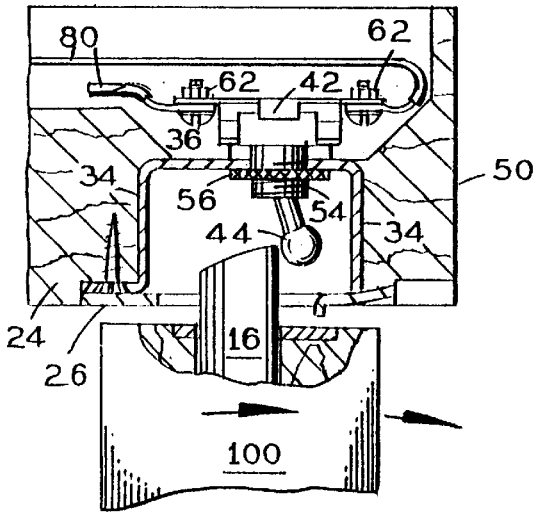
FIG. 5
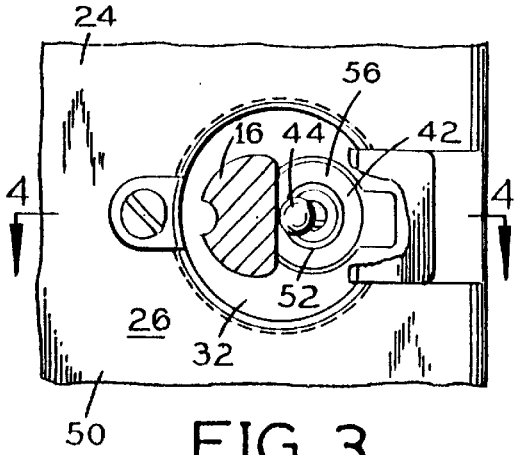
FIG. 3
FIG. 6
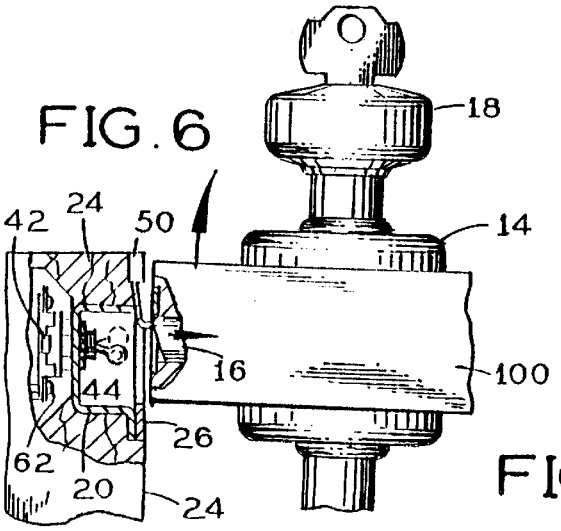
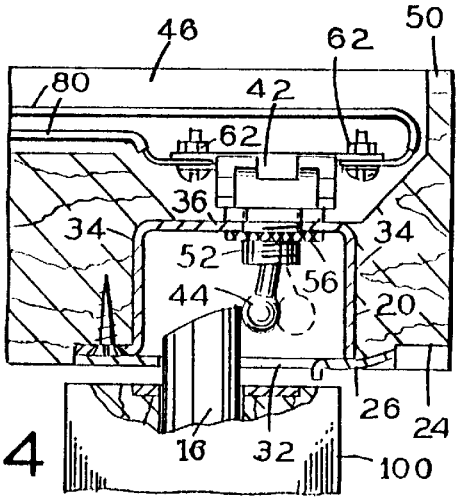
FIG. 4

DOOR AND WINDOW LOCK WITH BURGLAR ALARM

FILING HISTORY

This application is a continuation-in-part of application Ser. No. 09/033,297, filed on Mar. 2, 1998, now abandoned.

BACKGROUND OF THE INVENTION

1. Field of the Invention

The present invention relates generally to the field of security devices for buildings, and particularly for homes. More specifically the present invention relates to a door or window lock including a bolt receiving housing containing an alarm circuit and a conventional bolt assembly which advances a bolt into and retracts the bolt from the housing with the turn of a knob or a key. For one embodiment, the bolt receiving housing is a metal box fitted into a recess in a door frame. The box has a box forward wall with a bolt receiving opening, box side walls and a box rearward wall through which a lever switch is mounted so that the switch lever extends forwardly into the box. The box is sized in depth relative to the throw and position of the bolt so that the thrown bolt extends into the box to an extent that it is laterally adjacent to the switch lever. The remainder of the switch extends rearwardly from the rear wall of the box into an electrical raceway in the building wall.

When the bolt is thrown to lock the door or window, movement of the door or window toward an open position drives the bolt laterally against the switch lever and thereupon pivots the lever to throw the switch and complete the alarm circuit to cause the alarm to sound. Thus the alarm is sounded while the bolt remains intact and in advance of intruder entry into the building. To shut off the alarm, the building owner simply unlocks the bolt, reaches into the housing with a finger or a tool, and throws the switch lever back into the deactivation position.

2. Description of the Prior Art

There have long been bolts and alarms for inhibiting intruder entry into buildings. These have in some instances been combined mechanisms in which breaking or lateral movement of the bolt triggers the alarm. A problem with these latter prior devices has been that generally they do not operate in concert with the conventional bolt assembly many people have on their doors, which are conveniently operated with house keys. In these instances the alarm must be set, neutralized and deactivated in a separate operation from simply locking and unlocking the door, thus discouraging hurried people from using their alarm systems all of the time. Alternatively, in the few instances in which a generally conventional bolt assembly is used, deactivation of a triggered alarm can be complicated and difficult.

One such prior device is that of Makishima, U.S. Pat. No. 2,660,632, issued on Nov. 24, 1953. Makishima discloses a burglar alarm safety lock using an apparently conventional bolt, having a bolt receptacle including a button switch which activates the alarm when depressed. The switch button is positioned at the side of the extended bolt toward which the bolt would move upon opening the door. A cantilever-mounted tab extends between the bolt and the button, so that when sufficient pressure is exerted against the door, the bolt bends the tab against the button and the tab remains bent so that the button remains pressed and the alarm remains activated. A problem with Makishima is that deactivating the alarm requires bending the tab back out of contact with the switch button, which is awkward in part because the tab is contained within the bolt receptacle.

Queren, U.S. Pat. No. 4,390,867, issued on Jun. 28, 1983, teaches a burglar alarm system. Queren reveals another bolt and bolt receptacle arrangement in which attempting to open the door causes lateral movement of the bolt against a plate which bends the plate to cause electrical contact with a screw which completes the alarm circuit. As in Makishima, the bent plate often must be bent back to its original position to deactivate the alarm.

Maged, U.S. Pat. No. 3,851,325, issued on Nov. 26, 1974, teaches a combined lock and alarm apparatus. Maged includes a bolt assembly for mounting on the door and a bolt receiving structure for mounting on the door frame. The alarm circuit is contained within the bolt assembly housing and includes spaced apart electrical contacts. A bolt slide stem extends laterally from the bolt out of the bolt assembly housing through a stem slot. The alarm circuit includes a sound generator wired to a power source and a pair of spring-biased electrical contacts placed within the sliding path of the stem. The bolt is spring-biased outwardly toward the door frame. The bolt receiving structure includes a guide flange against which the biased bolt rests, and along which the bolt slides if the door is pushed in a door opening direction while the bolt is thrown. Movement of the bolt beyond the guide flange permits the bolt to extend further into the bolt receptacle, so that the stem rides against and presses the electrical contacts together to sound the alarm. A problem with Maged is that no provision apparently is made for use of an ordinary bolt assembly with its household key. The bolt as illustrated must be operated from within the building by moving the bolt stem. Bobrowski, et al., U.S. Pat. No. 3,755,802, issued on Aug. 28, 1973 teaches a similar bolt assembly containing an alarm circuit.

Engstrom, et al., U.S. Pat. No. 4,587,517, issued on May 6, 1986, reveals an intrusion sensing device. Engstrom, et al., provides a bolt and a bolt receptacle having a bolt receiving opening surrounded by a paper and adhesive layer. The layer contains a conductor segment of an alarm circuit made of a frangible material such as conductive ink. Applying pressure to open the door from a closed position without retraction of the bolt transmits force to strike plate fasteners causing a slight displacement of the strike plate, in turn causing the surface of the frame surrounding the fasteners to fracture. The conductor segment in the paper and adhesive layer breaks as a result, sounding the alarm. Problems with Engstrom, et al. are that the broken conductive material must be replaced after activation, and the alarm does not sound until the door frame is already damaged and perhaps entirely broken.

Mickel, U.S. Pat. No. 4,912,456, issued on Mar. 27, 1990, discloses a door latch alarm. Mickel includes a housing including first and second compartments. The lower first compartment wherein the first compartment includes a deadbolt latch and a secondary bolt integrally formed with a first switch projecting through a slot communicating from the first to the second compartment. The first switch, upon retraction of the secondary bolt, completes an electrical circuit to activate an audible alarm. A second switch is directed outwardly of the second compartment to deactivate the circuit. The problems of Maged are once again presented.

Albert, U.S. Pat. No. 3,978,467, issued on Aug. 31, 1976, discloses a door alarm system responsive to forced entry. Albert includes a contact plate attached to a door frame spaced apart from the latch plate. The two plates are electrically insulated from each other and mounted so that the latch plate moves if any attempt is made to force the door latch. The two plates are connected to a circuit, the circuit including a contact relay and a thermal relay. When the two plates contact each other, no matter how instantaneously, the contact relay is energized. The alarm circuit is maintained until a certain amount of time has elapsed. A problem with Albert is that complex circuitry is required, and because of its complexity this circuitry is more likely to malfunction.

It is thus an object of the present invention to provide a door and window securing combined alarm and bolt apparatus which simultaneously locks the door or window and sets an alarm against unauthorized entry.

It is another object of the present invention to provide such an apparatus which permits partial opening of the door or window before the bolt abuts a stop to prevent further movement, sounding the alarm during this interval, so that the alarm sounds prior to intruder entry, giving building occupants and police greater response time.

It is finally an object of the present invention to provide such an apparatus which is strong, simple, reliable and relatively inexpensive to manufacture.

SUMMARY OF THE INVENTION

The present invention accomplishes the above-stated objectives, as well as others, as may be determined by a fair reading and interpretation of the entire specification.

An alarm and bolt apparatus is provided for a building opening closure panel hingedly mounted within a perimeter frame in a building opening, including a bolt assembly having a bolt and a mechanism for extending and retracting the bolt, a bolt receiving housing fitted into the closure panel frame, the housing having a forward wall portion with a bolt receiving opening, a side wall portion and a rearward wall portion, an alarm circuit within the building, and a lever switch with a switch lever for operating the switch and electrical switch terminals connecting the switch within the alarm circuit, the switch lever extending within the bolt receiving housing, where the housing is sized in depth relative to the throw of the bolt so that when the bolt is fully extended from the bolt assembly, the bolt extends into the housing to an extent that the bolt is positioned laterally adjacent to the switch lever, so that when the closure panel is moved toward an open position, such movement drives the bolt laterally against the switch lever and thereupon pivots the switch lever to operate the switch and thereby complete the alarm circuit to cause an alarm to sound.

The switch preferably includes a mounting tube extending through the housing rearward wall portion and having external threads and a mounting nut for screwing over the mounting tube to secure the switch to the housing rearward wall portion, where the switch lever protrudes into the housing and the remainder of the switch extends rearwardly from the rearward wall portion. The bolt receiving housing preferably includes four side walls and a rear wall through which the lever switch is mounted so that the switch lever extends forwardly into the box.

An alarm and bolt apparatus is further provided for a building opening closure panel hingedly mounted within a perimeter frame in a building opening, including a bolt assembly having a bolt and a mechanism for extending and retracting the bolt, a bolt receiving housing mounted to the perimeter frame adjacent to the door bolt assembly, the housing having a forward wall portion with a bolt receiving opening, a side wall portion and a rearward wall portion, an alarm circuit within the building, a buffer flange with the housing extending parallel to the forward wall portion and away from the perimeter frame, two closely spaced apart electrical contacts within the alarm circuit, one of the electrical contacts being biased into the spaced position away from the second electrical contact, where the bolt opening extends outwardly from the building wall beyond the buffer flange, and where the first electrical contact extends outwardly from the building wall beyond the buffer flange, and where movement of the closure panel toward an open position causes the bolt to ride along the buffer flange and, upon passing the buffer flange, the bolt abruptly advances further into the housing and against the first electrical contact, moving the first electrical contact toward and into contact with the second electrical contact, thereby completing the alarm circuit and activating an alarm.

The alarm circuit preferably includes a power source and a sound generator electrically connected to the power source, the power source and the sound generator being mounted to the housing side wall portion, where the bolt assembly includes a bolt housing with a perimeter fastening flange, a throw lever protruding from the bolt housing, a key and key receiving cylinder passing through the closure panel to the building exterior and internal mechanical elements causing the bolt to extend and withdraw upon rotation of one of the throw lever and the key, and where the bolt is spring-biased to extend into the bolt opening when thrown, and presses against the buffer flange.

BRIEF DESCRIPTION OF THE DRAWINGS

Various other objects, advantages, and features of the invention will become apparent to those skilled in the art from the following discussion taken in conjunction with the following drawings, in which:

FIG. 1 is a partial perspective view of a door and a building wall fitted with the inventive bolt and alarm apparatus of the first embodiment.

FIG. 2 is a partial cross-sectional top view of the door frame and door and of the bolt and alarm apparatus of FIG. 1, showing the conventional door bolt, latch box and raceway containing the alarm circuit, the switch lever being laterally abutted by the door bolt and thus on the verge of alarm activation.

FIG. 3 is a side view looking into the latch box at the lever switch and the end of the door bolt, showing the door bolt abutting the switch lever as in FIG. 2.

FIG. 4 is a view as in FIG. 2, but showing in broken lines the switch lever pivoted into an alarm activating position.

FIG. 5 is a view as in FIG. 4, with the lever switch actually thrown to activate the alarm.

FIG. 6 is a view as in FIG. 2, but showing in broken lines the switch lever pivoted into an alarm activating position.

DETAILED DESCRIPTION OF THE PREFERRED EMBODIMENTS

Figure 7:
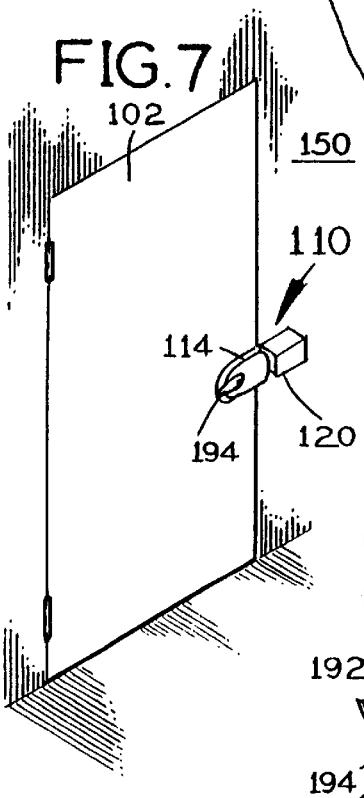
FIG. 7 is a perspective view of a door and a building wall fitted with the inventive bolt and alarm apparatus of the second embodiment.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Referring to FIGS. 1–6, a door and window lock apparatus 10 is disclosed, including a bolt receiving housing 20 containing an alarm circuit 80 and a conventional bolt assembly 14 which advances a bolt 16 into and retracts the bolt 16 from the housing 20 with the turn of a knob 18 or a key (not shown). The port in a building in which a door or window is mounted will be referred to hereinafter as a building opening 102, and the door or window itself will be hereinafter referred to as a building opening closure panel or simply as a closure panel 100.

The bolt receiving housing takes the form of a metal box 20 fitted into a recess 22 in a door frame 24. The term "door frame" is used herein to refer to any perimeter structure within which a door or a window is mounted. Box 20 has a box forward wall 26 with a bolt receiving opening 32, four box side walls 34 and a box rearward wall 36 through which a lever switch 42 is mounted so that the switch lever 44 extends forwardly into box 20. Box 20 is sized in depth relative to the throw and position of bolt 16 so that the thrown bolt 16 extends into box 20 to an extent that it is laterally adjacent to switch lever 44. The remainder of switch 42 extends rearwardly from box rearward wall 36 into an electrical raceway 46 in the building wall 50. Switch 42 is of conventional design and has a switch body including a mounting tube 52 having external threads 54 which surrounds the base of switch lever 44 and passes through an opening in box rearward wall 36, and a mounting nut 56 screws over mounting tube 52 to secure switch 42 to box 20. Terminals 62 on switch 42 are connected to an ordinary alarm circuit 80 within the raceway 46.

When the bolt 16 is thrown to lock the door or window, pressure against the door or window to move the door or window toward an open position drives the bolt 16 laterally against switch lever 44 and thereupon pivots the lever 44 to throw switch 42 and thereby complete alarm circuit 80 to cause the alarm to sound. Thus the alarm is sounded while the bolt 16 remains intact and in advance of intruder entry into the building. To shut off the alarm, the building owner simply unlocks apparatus 10 by retracting bolt 16, reaches into box 20 with a finger or a tool, and throws switch lever 44 back into the deactivated position.

SECOND PREFERRED EMBODIMENT

Figure 8:
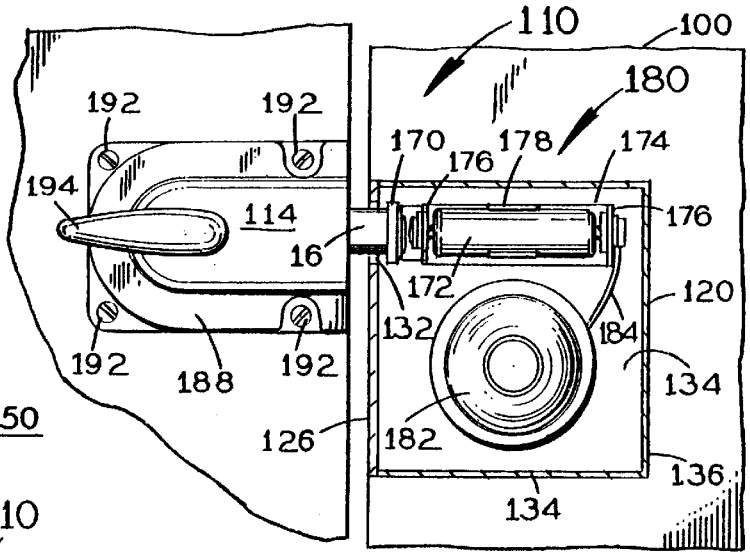
FIG. 8 is a close-up plan view of the bolt assembly and latch box in place on a door and door frame with the bolt thrown to enter the latch box, the latch box being shown in cross-section revealing the elements of the alarm circuit.
Figure 9:
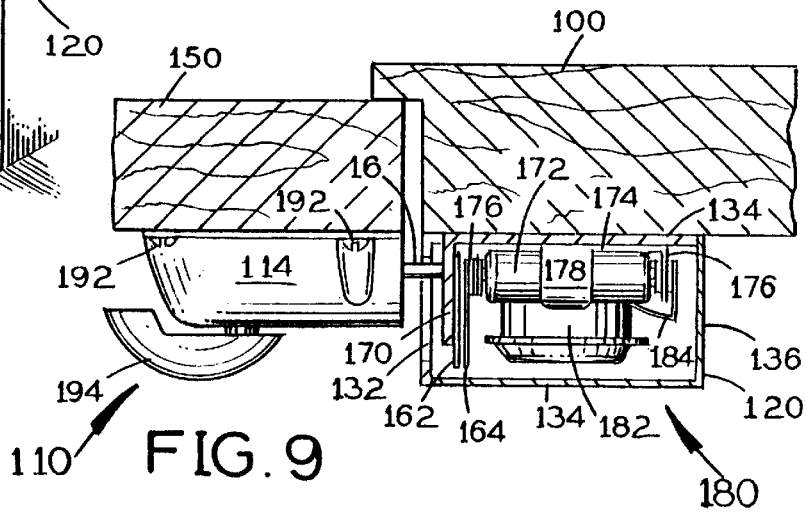
FIG. 9 is a cross-sectional top view of the bolt assembly and latch box of FIG. 8, with the door fully closed.
Figure 10:
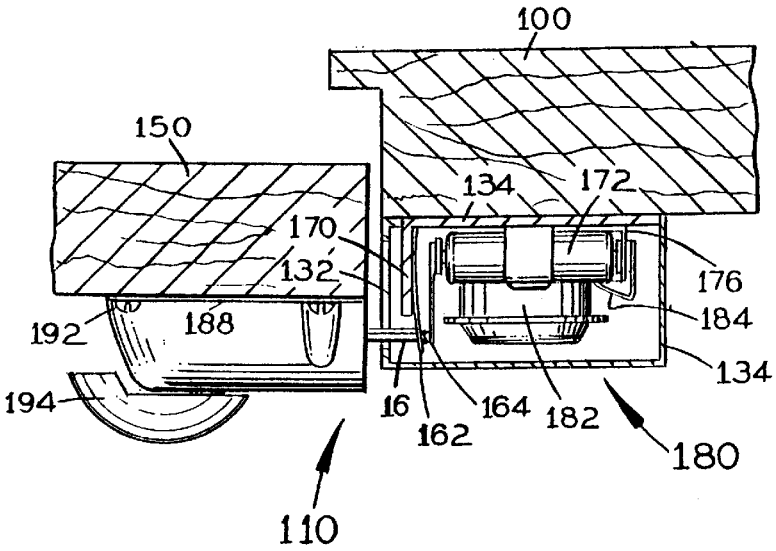
FIG. 10 is a view as in FIG. 9 with the door open to the extent the bolt permits before abutting the end of the bolt opening and stopping the door, with the bolt extended beyond the buffer flange and pressing one of the contacts into touching relation with the other contact, activating the alarm.

For a second embodiment, the apparatus 110 housing is preferably mounted externally to the interior building wall 150 adjacent to the door bolt assembly 114. See FIGS. 7–10. The housing preferably is a box 120 including a box forward wall 126 with an elongated bolt opening 132, a box rearward wall 136, and outer, inner and lateral box side walls 134. Box 120 contains a buffer flange 170 extending parallel to box forward wall 126 and just inside bolt opening 132, from the box side wall 134 adjacent to building wall 150. Adjacent and parallel to buffer flange 170, between the buffer flange 170 and the box rearward wall 136, are first and second closely spaced apart, spring-biased electrical contacts 162 and 164. Bolt opening 132 extends out from the building wall 150 beyond buffer flange 170, and the two contacts 162 and 164 extend away from the building wall 150 beyond the buffer flange 170 as well.

Contacts 162 and 164 are part of an electrical alarm circuit 180 contained within box 120 and including a power source which is either a battery 172 or household current suitably stepped down by a transformer (not shown), a battery mounting bracket 174 with battery terminal contacts 176 and a resilient battery clip 178, and a buzzer sound generator 182 of conventional design connected to the power source by a circuit wire 184. These elements are all mounted to the box side wall 134 adjacent the building wall 150 with suitable fastening means.

Bolt assembly 114 is mounted on the closure panel 100, and as indicated above, is of ordinary design. Bolt assembly 114 preferably includes a bolt assembly housing 186 with a perimeter fastening flange 188 with screws 192 in ports, a throw lever 194 protruding from bolt assembly housing 186, a key receiving cylinder 196 passing through the closure panel 100 to the building exterior and internal mechanical elements (not shown) causing the bolt 16 to extend and withdraw upon rotation of the bolt lever 194 or key. Bolt 116 is spring-biased to extend into bolt opening 132 when thrown, and presses against buffer flange 170. An external force against the closure panel 100 or window in an opening direction causes the bolt 116 to ride along buffer flange 170. Upon passing the free end of buffer flange 170, bolt 116 abruptly extends further into box 120 and bears against the closest, first electrical contact 162. The biasing of bolt 116 is greater than the spring resistance of first electrical contact 162, and bends the contact 162 toward and into contact with the second electrical contact 164, completing the alarm circuit 180. As a result of circuit completion, the buzzer sound generator sounds 182.

Once again, as for the first embodiment, the alarm is activated prior to the bolt being broken, so that there is deterrence before intruder entry and more response time is provided for police arrival. The bolt 116 cannot ride back onto buffer flange 170 once it rides off the flange 170 end, and so the bolt 116 keeps the contacts 162 and 164 together and the alarm sounding until the bolt 116 is retracted by the building owner.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An alarm and bolt apparatus for a building opening closure panel hingedly mounted within a perimeter frame in a building opening, comprising:

a bolt assembly including a bolt and means for extending and retracting said bolt, a bolt receiving housing fitted into said closure panel frame, said housing having a forward wall portion with a bolt receiving opening, a side wall portion and a rearward wall portion, an alarm circuit within said building, and a lever switch with a switch lever for operating said switch and electrical switch terminals connecting said switch within said alarm circuit, said switch lever extending within said bolt receiving housing, wherein said housing is sized in depth relative to the throw of said bolt such that when said bolt is fully extended from said bolt assembly, said bolt extends into said housing to an extent that said bolt is positioned laterally adjacent to said switch lever, such that when said closure panel is moved toward an open position, such movement drives said bolt laterally against said switch lever and thereupon pivots said switch lever to operate said switch and thereby complete said alarm circuit to cause an alarm to sound.

2. The apparatus of claim 1, wherein said switch comprises a mounting tube extending through said housing rearward wall portion and having external threads and a mounting nut for screwing over said mounting tube to secure said switch to said housing rearward wall portion, wherein said switch lever protrudes into said housing and the remainder of said switch extends rearwardly from said rearward wall portion.

3. The apparatus of claim 1, wherein said bolt receiving housing comprises four side walls and a rear wall through which said lever switch is mounted such that the switch lever extends forwardly into the box.

4. An alarm and bolt apparatus for a building opening closure panel hingedly mounted within a perimeter frame in a building opening, comprising:

a bolt assembly including a bolt and means for extending and retracting said bolt, a bolt receiving housing mounted to said perimeter frame adjacent to said door bolt assembly, said housing having a forward wall portion with a bolt receiving opening, a side wall portion and a rearward wall portion, an alarm circuit within said building, a buffer flange with said housing extending parallel to said forward wall portion and away from said perimeter frame, two closely spaced apart electrical contacts within said alarm circuit, one said electrical contact being biased into said spaced position away from said second electrical contact, wherein said bolt opening extends outwardly from the building wall beyond said buffer flange, and wherein said first electrical contact extends outwardly from said building wall beyond said buffer flange, and wherein movement of said closure panel toward an open position causes said bolt to ride along said buffer flange and, upon passing said buffer flange, said bolt abruptly advances further into said housing and against said first electrical contact, moving said first electrical contact toward and into contact with said second electrical contact, thereby completing said alarm circuit and activating an alarm.

5. The apparatus of claim 4, wherein said alarm circuit includes a power source and a sound generator electrically connected to said power source, said power source and said sound generator being mounted to said housing side wall portion, wherein said bolt assembly comprises a bolt housing with a perimeter fastening flange, a throw lever protruding from said bolt housing, a key and key receiving cylinder passing through said closure panel to the building exterior and internal mechanical means causing said bolt to extend and withdraw upon rotation of one of said throw lever and said key, and wherein said bolt is spring-biased to extend into said bolt opening when thrown, and presses against said buffer flange.

* * * * *